United States Patent [19]

Wong et al.

[11] Patent Number: 4,960,667

[45] Date of Patent: Oct. 2, 1990

[54] POSITIVELY CHARGED BLACK LIQUID ELECTROPHOTOGRAPHIC DEVELOPER COMPOSITIONS

[75] Inventors: Raymond W. Wong, Mississauga; Stephan Drappel, Toronto; Melvin D. Croucher, Oakville, all of Canada

[73] Assignee: Xerox Corporation, Stamford, Conn.

[21] Appl. No.: 202,347

[22] Filed: Jun. 6, 1988

[51] Int. Cl.[5] ..... G03G 9/12

[52] U.S. Cl. ..... 430/114

[58] Field of Search ..... 430/112, 114

[56] References Cited

U.S. PATENT DOCUMENTS

| | | | |
|---|---|---|---|
| 3,535,244 | 10/1970 | Zabiak | 430/116 |
| 3,869,397 | 3/1975 | Tellier | 430/114 |
| 3,939,087 | 2/1976 | Vijayendran et al. | 430/114 |
| 3,954,640 | 5/1976 | Lu et al. | 430/112 X |
| 3,963,510 | 6/1976 | Osswald | 106/402 |
| 3,980,577 | 9/1976 | Hotta | 430/106 |
| 3,990,980 | 11/1976 | Kosel | 430/113 |
| 4,005,022 | 1/1973 | Vijayendran | 430/115 X |
| 4,473,630 | 9/1984 | Yokoya | 430/137 |
| 4,476,210 | 10/1984 | Croucher et al. | 430/114 |
| 4,507,377 | 3/1985 | Alexandrovich | 430/116 X |
| 4,663,264 | 5/1987 | Mitchell | 430/115 |
| 4,783,389 | 11/1988 | Trout et al. | 430/114 X |

*Primary Examiner*—J. David Welsh

*Attorney, Agent, or Firm*—E. O. Palazzo; Judith L. Byurick

[57] ABSTRACT

A positively charged liquid developer composition comprised of resin particles, a hydrocarbon, laked carbon black particles, and a charge director.

17 Claims, No Drawings

POSITIVELY CHARGED BLACK LIQUID ELECTROPHOTOGRAPHIC DEVELOPER COMPOSITIONS

BACKGROUND OF THE INVENTION

This invention is directed to developer compositions and more specifically positively charged liquid developer compositions containing as charge directing components zirconium octoate, iron naphthenate, and a polyisobutylene based polyester. In one embodiment, the present invention is directed to positively charged liquid developer compositions comprised of resin particles, carbon blacks, particularly laked carbon blacks available from Paul Uhlich, Inc. as Toner 8200 and Toner 8500; and a charge director. The liquid inks of the present invention can be selected for the development of images in various imaging processes, including the liquid developer processes described in U.S. Pat. No. 3,084,043, the disclosure of which is totally incorporated herein by reference; xerographic processes, electrographic recording, electrostatic printing, and facsimile systems; color proofing processes; and the process as illustrated in British Patent Publication 2,169,416, published July 9, 1986, the disclosure of which is totally incorporated herein by reference.

Development of electrostatic latent images with liquid developer compositions comprised of, for example, a dispersion of pigments in a liquid hydrocarbon is known. In these methods, the electrostatic latent image, which is usually formulated on a single sheet of photoconductive paper, such as zinc oxide, is transported through a bath of the aforementioned liquid developer. Contact with the liquid developer causes the charged pigment particles present therein to migrate through the liquid to the zinc oxide sheet in the configuration of a charged image. Thereafter, the sheet is withdrawn from the liquid developer bath with the charged pigment particles adhering to the electrostatic latent image in image configuration. The thin film of residual developer remaining on the surface of the sheet is then evaporated within a relatively short time period, usually less than 5 seconds. Also, the marking pigment particles may be fixed to the sheet by heat, for example, in image configuration.

There are disclosed in U.S. Pat. No. 3,554,946 liquid developers for electrophotography comprised of a carrier liquid consisting of a hydrocarbon, negatively electrostatically charged toner particles dispersed in the carrier liquid, and a pigment therein such as carbon black, aniline black, prussian blue, phthalocyanine red, and cadmium yellow. In accordance with the teachings of this patent, a copolymer is coated on the surface of the pigment particles for the primary purpose of imparting a negative electrostatic charge to these particles. Other patents disclosing similar liquid developer compositions include 3,623,986; 3,625,897; 3,900,412; 3,976,583; 4,081,391 and 3,900,412. In the '412 patent, there is specifically disclosed a stable developer comprised of a polymer core with a steric barrier attached to the surface of the polymer selected. In column 15 of this patent, there are disclosed colored liquid developers by selecting pigments or dyes, and physically dispersing them by ball milling or high shear mixing. Attempts to obtain useful color liquid developer compositions by the ball milling process described have been substantially ineffective, particularly with respect to obtaining developed images of acceptable optical density in that, for example, the desired size for the latex particles is from 0.2 to 0.3 micron in diameter; and with ball milling techniques, it is very difficult to provide a dispersion of carbon black or other pigment particles much smaller in size than about 0.7 to about 0.8 micron. Consequently, the addition of carbon black pigment particles, for example, to latex particles with a diameter of 0.2 to 0.3 micron while ball milling would result in relatively small latex particles residing on the surface of the pigment particles. In contrast, with the invention of the present application, there are obtained pigmented polymer particles with an average diameter of from about 2 to about 6 microns permitting high transfer efficiencies since these larger particles do not migrate from the image during transfer as is the situation with submicron particles, and also the larger particles are not as strongly held to the photoreceptor surface.

Additionally, there are described in U.S. Pat. No. 4,476,210, the disclosure of which is totally incorporated herein by reference, liquid developers containing an insulating liquid dispersion medium with submicron size marking particles therein, which particles are comprised of a thermoplastic resin core substantially insoluble in the dispersion, an amphipathic block or graft copolymeric stabilizer irreversibly chemically or physically anchored to the thermoplastic resin core, and a colored dye imbibed in the thermoplastic resin core. There is also illustrated in this patent the use of zirconium octoate as a positive charge control agent with a vinyl resin and Isopar®. The history and evolution of liquid developers is provided in the '210 patent, reference columns 1 and 2 thereof.

Also of interest are U.S. Pat. No. 3,869,397, which discloses the use of zirconium octoate as a negative charge control agent for a carbon black pigment in a vinyl resin, and U.S. Pat. No. 3,939,087, which illustrates a liquid developer comprising a pigment, dye and polymer with zirconium octoate in Ispoar®, which octoate can apparently function as a charge director.

In addition, there are illustrated in the aforementioned British Patent Publication 2,169,416 liquid developer compositions comprising toner particles associated with a pigment dispersed in a nonpolar liquid, and wherein the toner particles are formulated with a plurality of fibers or tendrils from a thermoplastic polymer, and carry a charge of polarity opposite to the polarity of the latent image. These toners apparently permit, in some instances, excellent transfer efficiencies, and exhibit excellent copy quality.

Furthermore, there is illustrated in copending application U.S. Ser. No. 846,164, now abandoned, entitled Black Liquid Developer Composition, the disclosure of which is totally incorporated herein by reference, stable black submicron liquid developer comprised of an insulating liquid medium having dispersed therein black marking particles comprised of a thermoplastic resin core, which is substantially insoluble in the dispersion medium, and chemically or physically anchored to the resin core an amphipathic block or graft copolymer steric stabilizer, which is soluble in the dispersion medium; and wherein dyes comprised of a specific mixture are imbibed in the thermoplastic resin core with the mixture of dyes being dispersible at the molecular level, and therefore soluble in the thermoplastic resin core and insoluble in the dispersion medium.

Other patents of interest include 4,210,805, which discloses toner particles prepared by adding a solvent solution of polyvinylcarbazole to Isopar® wherein the diameter of the particles is a function of the ratio of solvent to Isopar®, reference column 8; 4,032,463 which illustrates that the ratio of toluene to Isopar® effects toner resin particle size; and 3,766,072 which appears to disclose that resin solvency in the vehicle effects the particle size. Also, in the '463 and '072 patents it is indicated that a solvency increase of the dispersion medium provides a larger final size particle. This occurs, it is believed, because one of the liquids used in formulating such developers is a solvent for the resin that is used. Consequently, the particle will be swollen by the entrapped solvent in the particle yielding a larger particle size. Also, in the polymerization process changing the solvent/nonsolvent ratio of the dispersion medium changes the kinetics and thus the mechanism by which particles are formed. With latex particle polymerization in hydrocarbon media, usually only submicron size particles are envisioned, reference for example "*Dispersion Polymerization in Organic Media*", ed. K. E. J. Barrett, Academic Press, 1975. However, it has recently been shown, reference M. A. Winnik, R. Lukas, W. F. Chen, P. Furlong, and M. D. Croucher, *Makromol. Chem.*, Makromol. Symp. 10/11, 488, (1987), that by varying the solvent/nonsolvent ratio of the dispersion medium for the polymer particle being formed that the particle size may be altered and particles up to 15 microns diameter may be formed. The advantage of this technique for liquid developers has recently been described in U.S. Pat. No. 4,789,616, the disclosure of which is totally incorporated herein by reference.

Although the above described liquid inks are suitable in most instances for their intended purposes, there remains a need for other liquid developers, particularly those types of inks as illustrated in British Publication 2,169,416, which inks can be positively charged enabling their utilization, for example, with layered imaging members which are negatively charged, reference U.S. Pat. No. 4,265,990, the disclosure which is totally incorporated herein by reference. Additionally, there is a need for positively charged liquid inks with acceptable transfer efficiencies, and wherein images with excellent resolutions and no background deposits are obtained. Furthermore, there is a need for positively charged inks with average particle diameters of from about 2 to about 3 microns. Additionally, there is a need for positively charged inks with laked carbon black pigments, which inks possess transfer efficiencies from imaging members to paper of greater than 95 percent and which possess reflection optical densities of greater than 1.2. Additionally, there is a need for liquid developer compositions that can be selected for a number of imaging processes including those illustrated in U.S. Pat. No. 3,084,043 and British Publication 2,169,416, the disclosures of which are totally incorporated herein by reference.

SUMMARY OF THE INVENTION

It is the object of the present invention to provide liquid developer compositions with the advantages illustrated herein.

In another object of the present invention there are provided positively charged liquid developer compositions.

Yet another object of the present invention is to provide positively charged liquid developer compositions with transfer efficiencies exceeding 85 percent, and in some instances 99 percent.

Furthermore, another object of the present invention is directed to liquid developer compositions comprised of resin particles, such as Elvax II 5720 commercially available, laked carbon black pigments, and charge directors such as zirconium octoate, iron naphthenate, or a polyisobutylene based polyester.

Moreover, in another object of the present invention there are provided liquid ink compositions useful in various development systems inclusive of electrostatic, printing, color proofing methods, and the like.

These and other objects of the present invention are accomplished by providing positively charged liquid developer compositions. More specifically, in one embodiment the present invention is directed to positively charged liquid ink compositions comprised of resin particles, laked carbon black particles, and charge directors. Therefore, in one specific embodiment of the present invention the liquid inks are comprised of resin particles, such as Elvax II 5720, a hydrocarbon such as petroleum distillates inclusive of the Isopars®, or mixtures thereof; carbon black laked with crystal violet dye, which was precipitated onto the surface thereof with molybdic acid, which laked carbon black is available from Paul Uhlich, Inc. as Toner 8200 and Toner 8500; and a charge director or charge control additive. Illustrative of the examples of polymer components include the Elvax resins, which are mainly polyethylenes that have been copolymerized with an acid, such as methacrylic acid or with vinyl acetate, and is present in the ink in an amount of from about 0.5 percent to 6 percent by weight, and preferably in an amount of from about 0.75 to 4 percent by weight. Examples of the laked carbon blacks are Toner 8200 and Toner 8500, which are obtained from Paul Uhlich, Inc., and are present in the Elvax II resin in an amount of from about 1 to 25 percent by weight, and preferably of from 12 to 22 percent by weight. The dispersion media comprised of petroleum distillates are commercially available as Isopar®, inclusive of Isopar® G, H, and L, poly (methacrylates), and are present in the ink in an amount of from about 90 to 99.5 weight percent, and preferably in an amount of from about 95 to 99 weight percent.

Examples of charge control additives that may be selected for the liquid developer compositions of the present invention, and that are present in an amount of from about 0.01 percent by weight to about 2.0 percent by weight, and preferably in an amount of from about 0.02 percent by weight to about 0.2 percent by weight, are zirconium octoate, iron naphthenate, a polyisobutylene based polyester, and the like. Mixtures of these materials may also be used. Preferred charge control additives are zirconium octoate, which is available from Nuodex Canada, a polyisobutylene based polyester, commercially available as Lubrizol L2936 from Lubrizol Corporation, and iron napthenate, commercially available from Nuodex Canada.

Examples of lake carbon blacks include Toner 8200 and Toner 8500 from Paul Uhlich and Company. Theoretically, any carbon black that has been laked with crystal violet dye may yield a surface that would permit a positively charged toner.

The liquid developers described herein can be prepared by mixing the resin particles, such as Elvax II 5720 available from E. I. DuPont company, and a hydrocarbon such as Isopar® L with heating at a temperature, for example, of 110° C. causing the resin to melt thereby enabling the formation of a resin/hydrocarbon mixture wherein the hydrocarbon function as a diluent for the resin and lowers its viscosity. Generally, the hydrocarbon is present in the mixture in an amount of from about 80 percent by weight to about 90 percent by weight, and preferably is present in a amount of from about 82 to about 94 percent by weight.

Subsequently, to the above prepared hydrocarbon/resin mixture at about 115° C. there is added the laked carbon black pigment, which pigment is present in an amount of from about 1 to about 25 percent by weight of the resin, and preferably is present in an amount of from about 12 to 22 percent by weight. Examples of pigments that can be selected include Toner 8200 and Toner 8500 available from Paul Uhlich, Hastingson-Hudson, N.Y.

After dispersion of the pigment in the molten resin, the mixture obtained is cooled to temperature over a period, for example, of from about 4 to 6 hours enabling particles with an average diameter of from about 2 to about 3 microns. The concentrated dispersion is then diluted with further Isopar ® L enabling the final liquid developer composition. Generally, the concentration of the pigment particles in the hydrocarbon is from about 0.5 percent by weight to about 10 percent by weight and preferably from about 1 percent to about 5 percent by weight. Thereafter, a charge control agent is added to the dispersion formed to enable an electrophoretic liquid developer composition.

The charge director is present in an amount of from about 0.01 percent by weight to about 2 percent by weight, and preferably is present in an amount of from about 0.02 percent by weight to about 0.2 percent by weight. Preferred charge control additives are zirconium octoate available from Nuodex Canada, iron naphthenate available from Nuodex Canada, and polyisobutylene based polyester available as Lubrizol L2936 from Lubrizol Corporation. The aforementioned preferred charge control additives impart a positive charge to the toner composition, which charge is dependent primarily on the interaction of the molecularly dissolved charge additive, and the pigment particles on the surface of the composite resin/pigment particle.

The ink compositions of the present invention are particularly useful in liquid development systems, such as those illustrated in the aforementioned British Patent Publication, and color proofing processes. More specifically, these processes involve depositing an electrostatic charge pattern on a photoreceptor or a dielectric surface, and then toning the electrostatic image with the liquid developer of the present invention, followed by electrostatically transferring to plain paper. In addition, the liquid developer compositions of the present invention are also useful for enabling the development of colored electrostatic latent images, particularly those contained on an imaging member charged positively or negatively. Examples of imaging members that may be selected are various known organic photoreceptors, including layered photoreceptors. Illustrative examples of layered photoresponsive devices include those with a substrate, a photogenerating layer, and a transport layer as disclosed in U.S. Pat. No. 4,265,990, the disclosure of which is totally incorporated herein by reference. Examples of photogenerating layer pigments are trigonal selenium, metal phthalocyanines, metal free phthalocyanines, and vanadyl phthalocyanine. Transport material examples include various diamines dispersed in resinous binders. Other organic photoresponsive materials that may be utilized in the practice of the present invention include polyvinyl carbazole; 4-dimethylaminobenzylidene; 2-benzylidene-aminocarbazole; (2-nitro-benzylidene)-p-bromoaniline; 2,4-diphenylquinazoline; 1,2,4-triazine; 1,5-diphenyl-3-methyl pyrazoline 2-(4'-dimethyl-amino phenyl)-benzoxazole; 3-amino-carbazole; polyvinyl carbazole-tritrofluorenone charge transfer complex; and mixtures thereof. Further imaging members that can be selected are ionographic surfaces of various dielectric materials, such as polycarbonate polysulfone fluoropolymers, and anodized aluminum alone or filled with wax expanded fluoropolymers.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

To 1,750 grams of ¼ inch stainless steel balls present in a Union Process 01 attritor was added 25 grams of Elvax II 5720 (DuPont), and 125 grams of Isopar ® L (Exxon). The attritor was heated to 115° C. under constant stirring after which 8 grams of Toner 8200 (Paul Uhlich) was added to the mixture, and dispersion continued for 30 minutes, after which a further 150 grams of Isopar ® L was added to the mixture, and attrition continued for a further hour. The attritor was then cooled to 25° C. over a period of two hours. Attrition was continued for a further three hours at 25° C.

The resulting dispersion had a solids content of 10.7 percent by weight with the average particle size diameter being 2.7 microns as measured using a Horiba centrifugal analyzer. The dispersion was then diluted to a particle concentration of 1.5 percent by weight by the addition of Isopar ® G (Exxon).

To 70 grams of the above dispersion was added 0.45 milliliters of 12 weight percent solution of zirconium octoate obtained from Nuodex Canada. The resulting ink (liquid developer) was then allowed to equilibriate for 24 hours. Electrical measurements indicated that the charge/mass ratio of the ink was 120 $\mu C\ g^{-1}$. The ink was then placed in a Savin 870 ® copier and the ink imaged in a reversal development mode. It was found that the transfer efficiency of the ink was 92 percent as measured gravimetrically while the optical density of the solid area was found to be 1.3 as measured with a Macbeth TR927 densitometer with a resolution of 8 line pairs/millimeters.

EXAMPLE II

The procedure described in Example I was repeated except that 1.05 gram of Lubrizol LZ936 was used as the charge director in place of the 0.45 milliliter of zirconium octoate. A unipolar positively charged ink with a charge/mass ratio of 110 $\mu C\ g^{-1}$ was obtained. When the ink was used in a Savin 870 ® copier with reversal development prints of an optical density of 1.2 were obtained, which exhibited a resolution of 8 line pairs/millimeters.

EXAMPLE III

The procedure described in Example I was repeated except that 0.12 gram of a 6 percent solution of iron naphthenate in a petroleum distillate was used in place of the 0.45 milliliter of zirconium octoate as the charge director. The resulting ink exhibited a unipolar positive charge ink with a charge/mass ratio of 90 $\mu C\ g^{-1}$. When the ink was used in a Savin 870® copier with reversal development, prints exhibiting an optical density of 1.2 were obtained.

EXAMPLE IV

The procedure described in Example I was repeated except that Toner 8500 was substituted for Toner 8200. A working ink was obtained which exhibited a unipolar positive charge with a charge/mass ratio of 110 $\mu C\ g^{-1}$. When this ink was imaged in reversal development in a Savin 870® copier, excellent copies with an optical density of 1.2 were obtained. The resolution of the images was 8 line pairs/millimeters.

EXAMPLE V

The liquid developer described in Example IV was prepared except that 0.12 gram of a 6 percent solution of iron naphthenate was used as the charge director in place of 0.45 milliliters of zirconium octoate. A unipolar positively charged developer exhibiting a charge/mass ratio of 100 $\mu C\ g^{-1}$ was obtained. When this ink was imaged in a reversal development mode in a Savin 870® copier, excellent copies exhibiting an optical density of 1.2 and a resolution of 8 line pairs/millimeters were obtained.

EXAMPLE VI

The liquid developer described in Example IV was prepared except that 1.1 grams of Lubrizol LZ936 was used in place of 0.45 milliliters of zirconium octoate as the charge director. A positively charged working ink was obtained, which exhibited a charge/mass ratio of 100 $\mu C\ g^{-1}$. When this ink was used in a Savin 870® copier in a reversal development mode, excellent copies exhibiting an optical density of 1.2 and a resolution of 8 line pairs/millimeters were obtained. The transfer efficiency of this ink from the Savin 870® photoreceptor to Xerox Corporation 4024® paper was found gravimetrically to be 90 percent.

Other modifications of the present invention may occur to those skilled in the art subsequent to a review of the present application, and these modifications are intended to be included within the scope of the present invention.

What is claimed is:

1. A positively charged liquid developer composition comprised of a hydrocarbon, toner particles consisting essentially of a resin and laked carbon black particles, and a charge director.

2. A developer composition in accordance with claim 1 wherein the resin particles are selected from the group consisting of copolymers of polyethylene and methacrylic acid, copolymers of polyethylene and vinyl acetate, and mixtures thereof.

3. A developer composition in accordance with claim 1 wherein a carbon black laked with crystal violet precipitated onto the surface thereof with molybdic acid is selected.

4. A composition in accordance with claim 1 wherein the charge director is selected from the group consisting of zirconium octoate, iron naphthenate, a polyisobutylene based polyester, and mixtures thereof.

5. A composition in accordance with claim 1 wherein the lake carbon black is selected from the group consisting of Toner 8200 and Toner 8500.

6. A composition in accordance with claim 1 wherein the charge director is present in an amount of from about 0.01 to about 2.0 weight percent.

7. A composition in accordance with claim 1 wherein the charge director is present in an amount of from about 0.02 to about 0.2 weight percent.

8. A composition in accordance with claim 1 wherein the resin is a polymer comprised of polyethylene copolymerized with methacrylic acid or vinyl acetate.

9. A composition in accordance with claim 8 wherein the polyethylene is present in an amount of from about 0.5 percent to about 6 percent by weight.

10. A composition in accordance with claim 1 wherein the developer composition has an average particle diameter of from about 2 to about 6 microns.

11. A method of imaging which comprises generating an image in an electrophotographic imaging apparatus; subsequently developing this image with the composition of claim 1; thereafter transferring the image to a suitable substrate; and permanently affixing the image thereto.

12. A method of imaging in accordance with claim 11 wherein the developed image exhibited a transfer efficiency of from about 80 to about 99 percent from the substrate.

13. A method of imaging in accordance with claim 12 wherein the substrate is paper.

14. A composition in accordance with claim 1 wherein the developer is of an average particle diameter of from about 2 to about 3 microns.

15. A composition in accordance with claim 1 wherein the hydrocarbon is a petroleum distillate.

16. A composition in accordance with claim 1 wherein the toner particles contain the resin in an amount of from about 75 to about 99 percent by weight and the laked carbon black particles in an amount of from about 1 to about 25 percent by weight.

17. A composition in accordance with claim 1 wherein the toner particles contain the resin in an amount of from about 78 to about 88 percent by weight and the laked carbon black particles in an amount of from about 12 to about 22 percent by weight.

* * * * *